US010029155B1

(12) United States Patent
Lo

(10) Patent No.: US 10,029,155 B1
(45) Date of Patent: Jul. 24, 2018

(54) INFLATABLE SPORTS BALL HAVING AN INNER BLADDER WITH RIB PLATES

(71) Applicants: Chien-Chuan Lo, Hua-Lien Hsien (TW); Yi-Chen Tsai, Hua-Lien Hsien (TW); Dongguan Broaden Sports Goods Ltd., Dongguan, Guang Dong Province (CN)

(72) Inventor: Chien-Chuan Lo, Hua-Lien Hsien (TW)

(73) Assignees: Chien-Chuan Lo, Hua-Lien Hsien (TW); Yi-Chen Tsai, Hua-Lien Hsien (TW); Dongguan Broaden Sports Goods Ltd., Guang Dong Province (CN)

( * ) Notice: Subject to any disclaimer, the term of this patent is extended or adjusted under 35 U.S.C. 154(b) by 0 days.

(21) Appl. No.: 15/643,977

(22) Filed: Jul. 7, 2017

(51) Int. Cl.
*A63B 41/02* (2006.01)
*A63B 43/00* (2006.01)

(52) U.S. Cl.
CPC ..... *A63B 43/00* (2013.01); *A63B 41/02* (2013.01); *A63B 43/002* (2013.01); *A63B 2209/00* (2013.01)

(58) Field of Classification Search
CPC ..... A63B 43/00; A63B 41/02; A63B 43/002; A63B 2209/00; A63B 41/04; A63B 2039/003; A63B 2039/006
See application file for complete search history.

(56) References Cited

U.S. PATENT DOCUMENTS 1,531,317 A * 3/1925 Stubbs ..... A63B 39/00 152/317
1,964,008 A * 6/1934 Roberts ..... A63B 39/00 267/35
2,294,424 A * 9/1942 Roberts ..... B29D 22/04 473/605
2,364,247 A * 12/1944 Shearer ..... F16K 15/202 473/610
5,224,704 A * 7/1993 Snell ..... A63B 41/00 273/DIG. 20
5,261,661 A * 11/1993 Lemmon ..... A63B 41/00 273/DIG. 20
5,865,697 A * 2/1999 Molitor ..... A63B 41/00 473/604
8,029,394 B2 * 10/2011 Burke ..... A63B 41/02 473/594
8,512,177 B2 * 8/2013 Krysiak ..... A63B 41/02 473/570
8,622,857 B2 * 1/2014 Lo ..... A63B 41/04 473/604

(Continued)

*Primary Examiner* — Steven Wong
(74) *Attorney, Agent, or Firm* — Lewis Roca Rothgerber Christie LLP

(57) ABSTRACT

An inflatable sports ball includes an outer cover defining an interior space and having a valve hole communicating with the interior space, an inner bladder disposed in the interior space and including two bladder halves fixed to each other, and an inflation unit disposed on the inner bladder and aligned with the valve hole. Each bladder half has an inner wall surface defining an inflatable space, and a peripheral edge surface connected to the peripheral edge surface of the other bladder half. The rib plates intersect with each other to divide the inflatable space into a plurality of inflatable regions.

9 Claims, 7 Drawing Sheets

(56) References Cited

U.S. PATENT DOCUMENTS

| | | | | |
|---|---|---|---|---|
| 2006/0063622 | A1* | 3/2006 | Nurnberg | A63B 41/02 473/604 |
| 2006/0293132 | A1* | 12/2006 | Laliberty | A63B 41/00 473/603 |
| 2009/0286632 | A1* | 11/2009 | Laliberty | A63B 41/00 473/603 |
| 2013/0085023 | A1* | 4/2013 | Wang | A63B 41/02 473/609 |
| 2014/0274504 | A1* | 9/2014 | Hu | A63B 37/06 473/604 |

* cited by examiner

INFLATABLE SPORTS BALL HAVING AN INNER BLADDER WITH RIB PLATES

FIELD

The disclosure relates to a sports ball, more particularly to an inflatable sports ball having an inner bladder with rib plates.

BACKGROUND

A conventional inflatable sports ball generally includes an outer cover, and a rubber inner bladder disposed inside the outer cover. The inner bladder uses synthetic or natural rubber as its main ingredient. In order to prevent the inner bladder from improper expansion or deformation due to increased inflation pressure during inflation of air into the inner bladder, the current commonly used solution is to wrap yarn or patches around an outer surface of the inner bladder, or to adhere a cloth liner around an inner surface of the outer cover. However, in actual manufacture, these methods require the use of a large number of devices, manufacturing processes and people to complete the manufacture. Furthermore, after high temperature vulcanization of the rubber outer cover and the rubber inner bladder, because the molecular structures of the materials are changed, the recycling rate thereof is low. Moreover, the rubber material must be mixed with a variety of additives (such as sulfur, zinc oxide, etc.) in order to carry out the high temperature vulcanization operation. Additionally, smoke and odor generated during this process can cause allergy or harm to the human body.

SUMMARY

Therefore, an object of the present disclosure is to provide an inflatable sports ball that can alleviate at least one of the drawbacks of the prior art.

According to this disclosure, an inflatable sports ball comprises an outer cover, an inner bladder and an inflation unit. The outer cover defines an interior space, and includes a valve hole communicating with the interior space. The inner bladder is disposed in the interior space, and includes two bladder halves fixed to each other. Each bladder half has a surrounding wall and a plurality of rib plates. The surrounding wall has an inner wall surface that defines an inflatable space, an outer wall surface opposite to the inner wall surface, and a peripheral edge surface interconnecting peripheral edges of the inner and outer wall surfaces. The rib plates intersect with each other to divide the inflatable space into a plurality of inflatable regions. The peripheral edge surfaces of the surrounding walls of the bladder halves are connected to each other. The inflation unit is disposed on the inner bladder and is aligned with the valve hole.

BRIEF DESCRIPTION OF THE DRAWINGS

Other features and advantages of the disclosure will become apparent in the following detailed description of the embodiments with reference to the accompanying drawings, of which.

DETAILED DESCRIPTION

Figure 1:
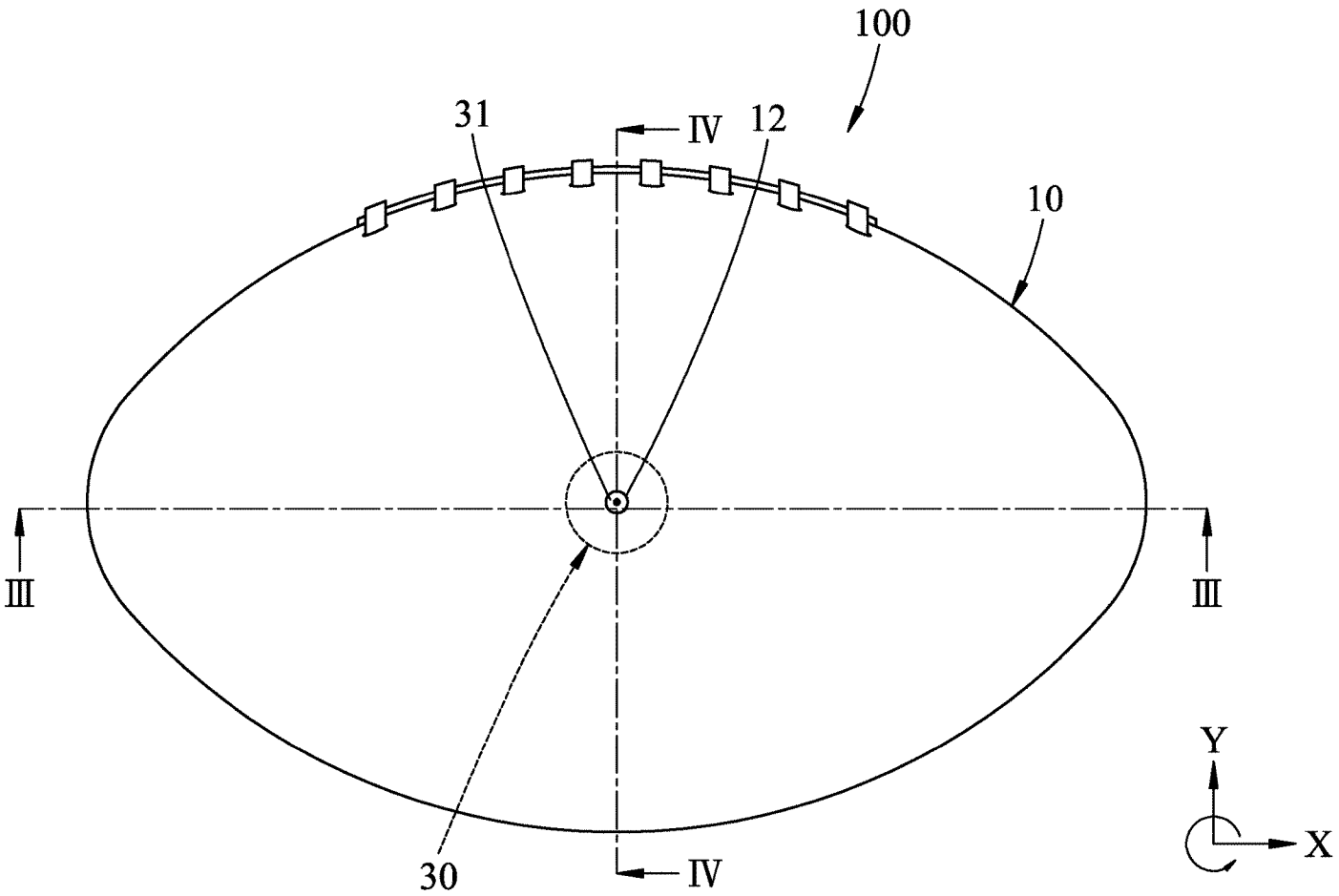
FIG. 1 is a schematic view of an inflatable sports ball according to the first embodiment of the present disclosure.
Figure 2:
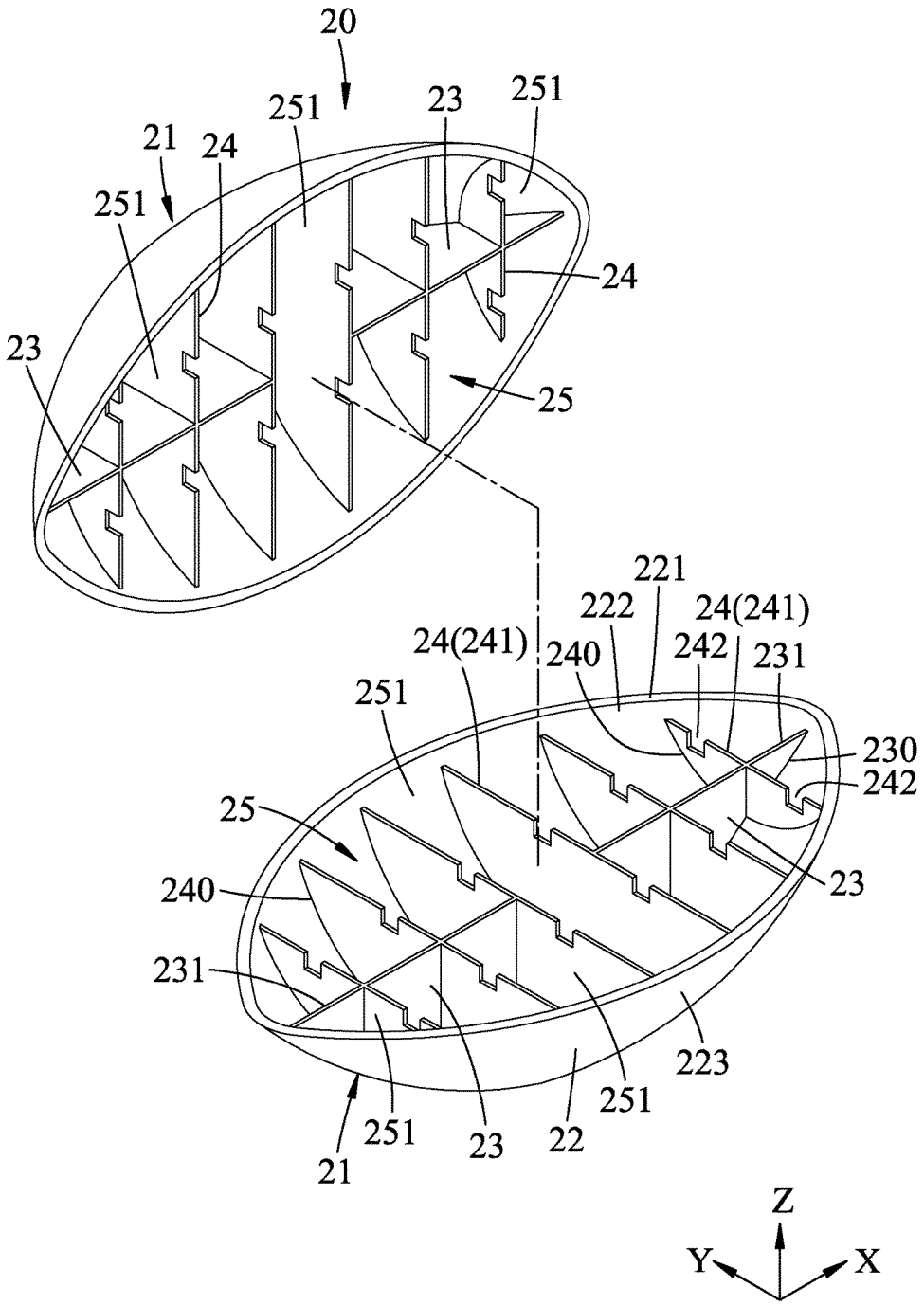
FIG. 2 is an exploded perspective view of an inner bladder of the first embodiment.

Before the present disclosure is described in greater detail with reference to the accompanying embodiment, it should be noted herein that like elements are denoted by the same reference numerals throughout the disclosure.

Referring to FIGS. 1 to 4, an inflatable sports ball 100 according to the first embodiment of the present disclosure is shown to include an outer cover 10, an inner bladder 20 and an inflation unit 30.

The outer cover 10 defines an interior space 11, and includes a valve hole 12 communicating with the interior space 11.

The inner bladder 20 is disposed in the interior space 11, and includes two bladder halves 21 fixed to each other. Each bladder half 21 can be made of a material selected from a group consisting of thermoplastic polyurethane (TPU), thermoplastic elastomer (TPE), thermoplastic polyolefin (TPO) and thermoplastic rubber (TPR). In this embodiment, each bladder half 21 is made of thermoplastic polyurethane (TPU), and has a surrounding wall 22, two first rib plates 23 and a plurality of second rib plates 24. The surrounding wall 22 has an inner wall surface 222 defining an inflatable space 25, an outer wall surface 223 opposite to the inner wall surface 222 and abutting against an inner wall surface of the outer cover 10, and a peripheral edge surface 221 interconnecting peripheral edges of the inner and outer wall surfaces 222, 223. In this embodiment, the peripheral edge surfaces 221 of the surrounding walls 22 of the bladder halves 21 are connected to each other using a hot melt machine or glue.

Since the structures of the bladder halves 21 are identical, only one of the bladder halves 21 will be described hereinafter. Each first rib plate 23 has a connecting end 230 connected to the inner wall surface 222 of the surrounding wall 22, and a free end 231 opposite to the connecting end 230. The first rib plates 23 extend along a first direction (X), and are spaced apart from each other along the first direction (X). Each second rib plate 24 has a connecting end 240 connected to the inner wall surface 222 of the surrounding wall 22, and a free end 241 opposite to the connecting end 240. The second rib plates 24 extend along a second direction (Y) transverse to the first direction (X), and are spaced apart from each other along the first direction (X). The second rib plates 24 intersect with the first rib plates 23 to divide the inflatable space 25 into a plurality of inflatable regions 251. Specifically, a half number of the second rib plates 24 intersect with one of the first rib plates 23, and the remaining half number of the second rib plates 24 intersect with another one of the first rib plates 23.

Figure 3:
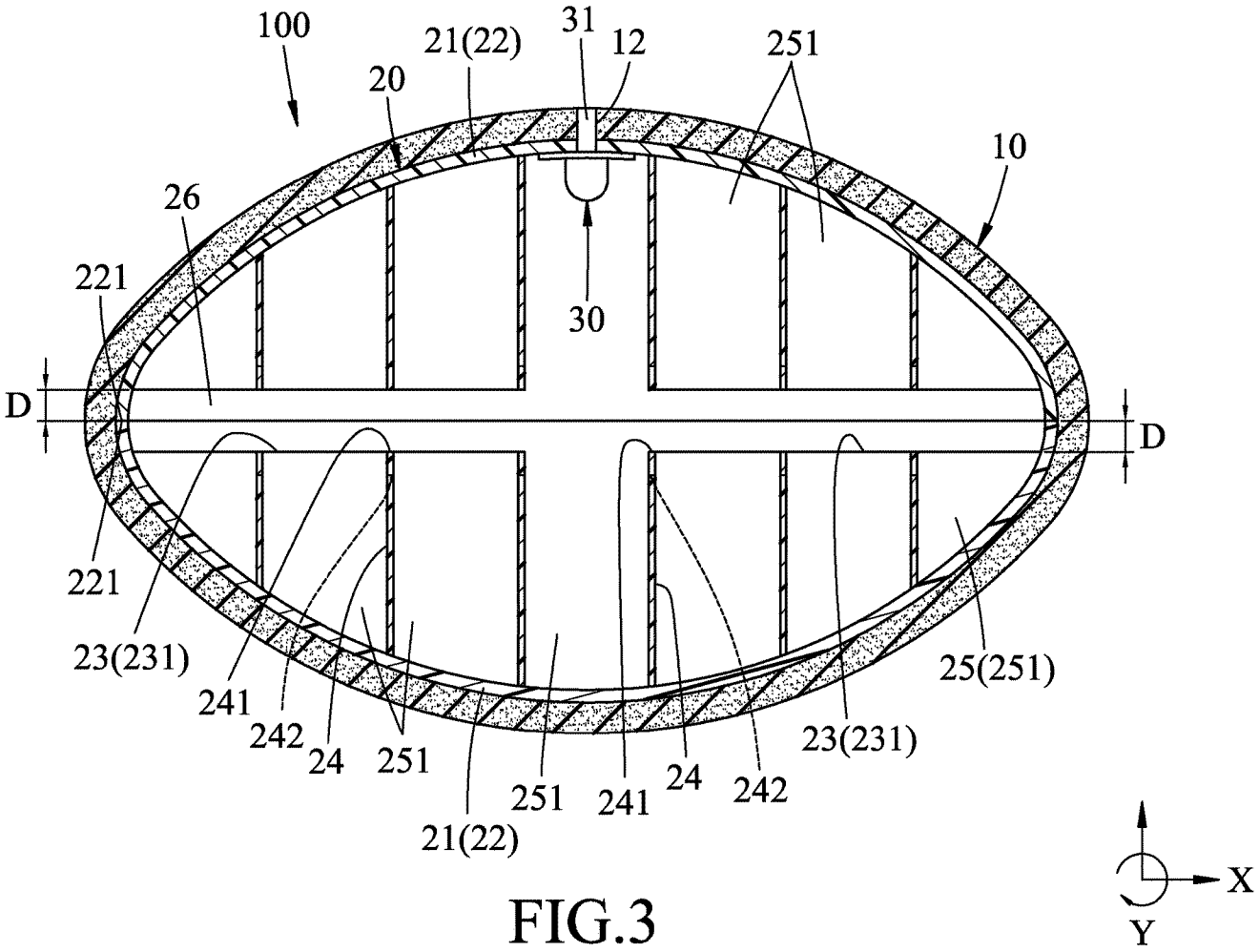
FIG. 3 is a sectional view of the first embodiment taken along line III-III of FIG. 1.
Figure 4:
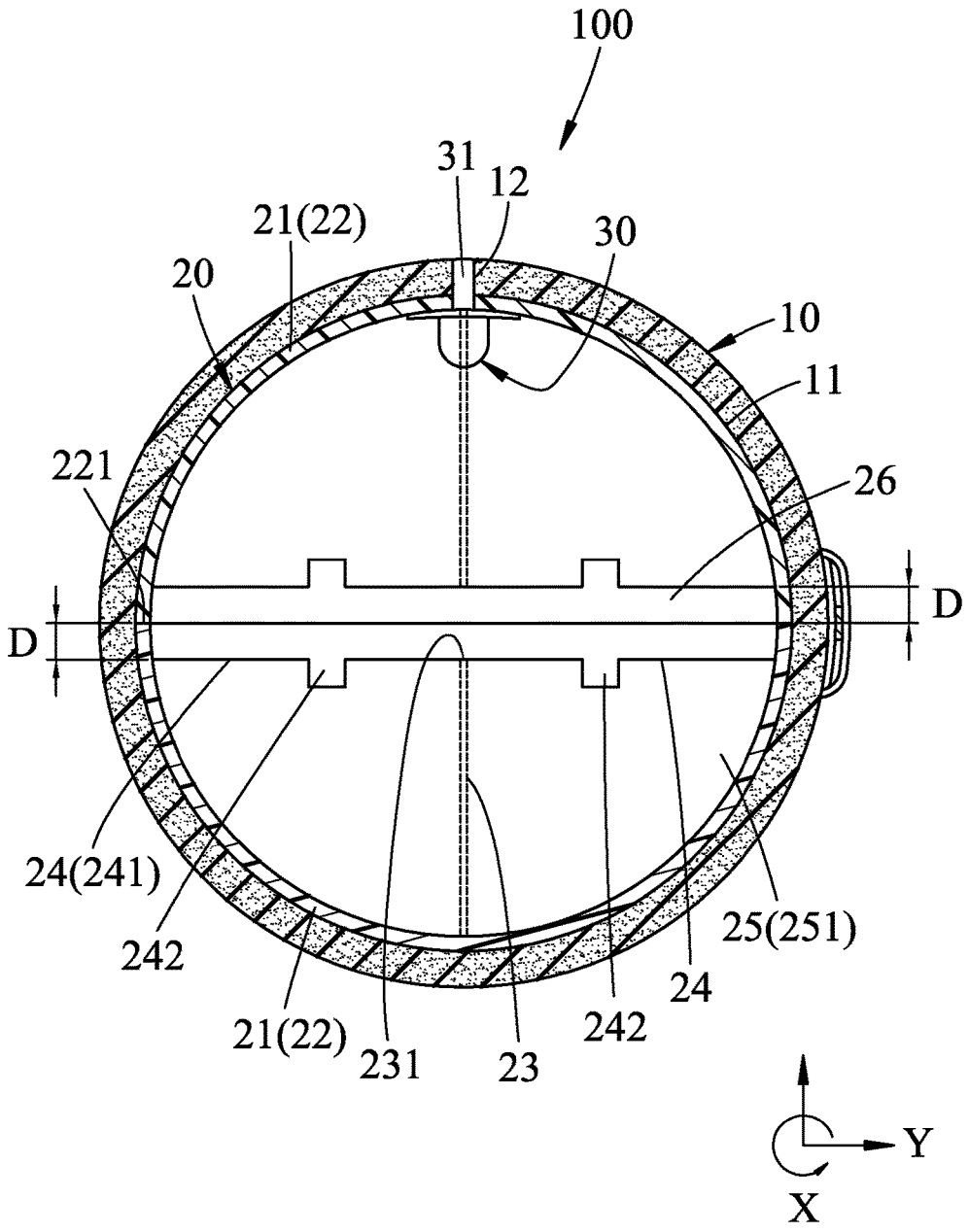
FIG. 4 is a sectional view of the first embodiment taken along line IV-IV of FIG. 1.

Each second rib plate 24 further has two grooves 242 extending inwardly from the free end 241 of a corresponding one of the second rib plates 24 and spaced apart from each other along the second direction (Y). The grooves 242 of each second rib plate 24 are located at two opposite sides of a corresponding one of the first rib plates 23. Each groove 242 communicates with two adjacent ones of the inflatable regions 251. In this embodiment, the free ends 231, 241 of the first and second rib plates 23, 24 are proximate to the peripheral edge surface 221 of the surrounding wall 22. Specifically, the free end 231, 241 of each of the first and second rib plates 23, 24 is spaced apart from the peripheral edge surface 221 of the surrounding wall 22 at a distance (D) not greater than 5 mm. As such, when the peripheral edge surfaces 221 of the surrounding walls 22 of the bladder halves 21 are interconnected, as shown in FIGS. 3 and 4, a flow channel 26 is formed between the free ends 231, 241 of the first and second rib plates 23, of the bladder halves 21. The flow channel 26 communicates with the inflatable regions 251.

The inflation unit 30 is disposed on the surrounding wall 22 of one of the bladder halves 21. In this embodiment, the inflation unit 30 has an air valve 31 aligned with the valve hole 12, and can be fixed to the surrounding wall 22 of the one of the bladder halves 21 by using a high frequency welding, ultrasonic welding or glue bonding method.

When air is inflated into the inner bladder 20 via the inflation unit 30, pressurized air is guided by the grooves 242 of the second rib plates 24 and the flow channel 26 to quickly flow into the inflatable regions 251 of the bladder halves 21 so as to fill the inner bladder 20 with air. During this process, the first and second rib plates 23, 24 can effectively limit the degree of expansion of the surrounding walls 22 of the bladder halves 21.

It should be noted herein that the grooves 242 of the second rib plates 24 of the bladder halves 21 may be dispensed with in other variations of this embodiment. In this case, only the flow channel 26 is used to guide the flow of the pressurized air.

From the aforesaid description, the advantages of this disclosure can be summarized as follows:

1) This disclosure uses the intersecting arrangement of the first and second rib plates 23, 24 of the bladder halves 21 to control the degree of expansion and shape of the surrounding walls 22 of the bladder halves 21 during inflation so as to effectively prevent improper expansion or deformation of the surrounding walls 22 of the bladder halves 21. In comparison with the prior art, this disclosure does not need to wrap yarn or patches around the outer wall surface of the inner bladder 20 or to adhere a cloth liner around an inner wall surface of the outer cover 10 for reinforcement. Hence, the manufacturing process of this disclosure can be simplified, and the manufacturing cost thereof can be reduced.

2) Since each bladder half 21 of this disclosure is made of TPU, there is no need to add a variety of additives during the production thereof, and the TPU material can be 100% recycled. In comparison with the prior art, this disclosure is not only environmentally friendly, but also will not cause allergy or harm to the human body.

Figure 5:
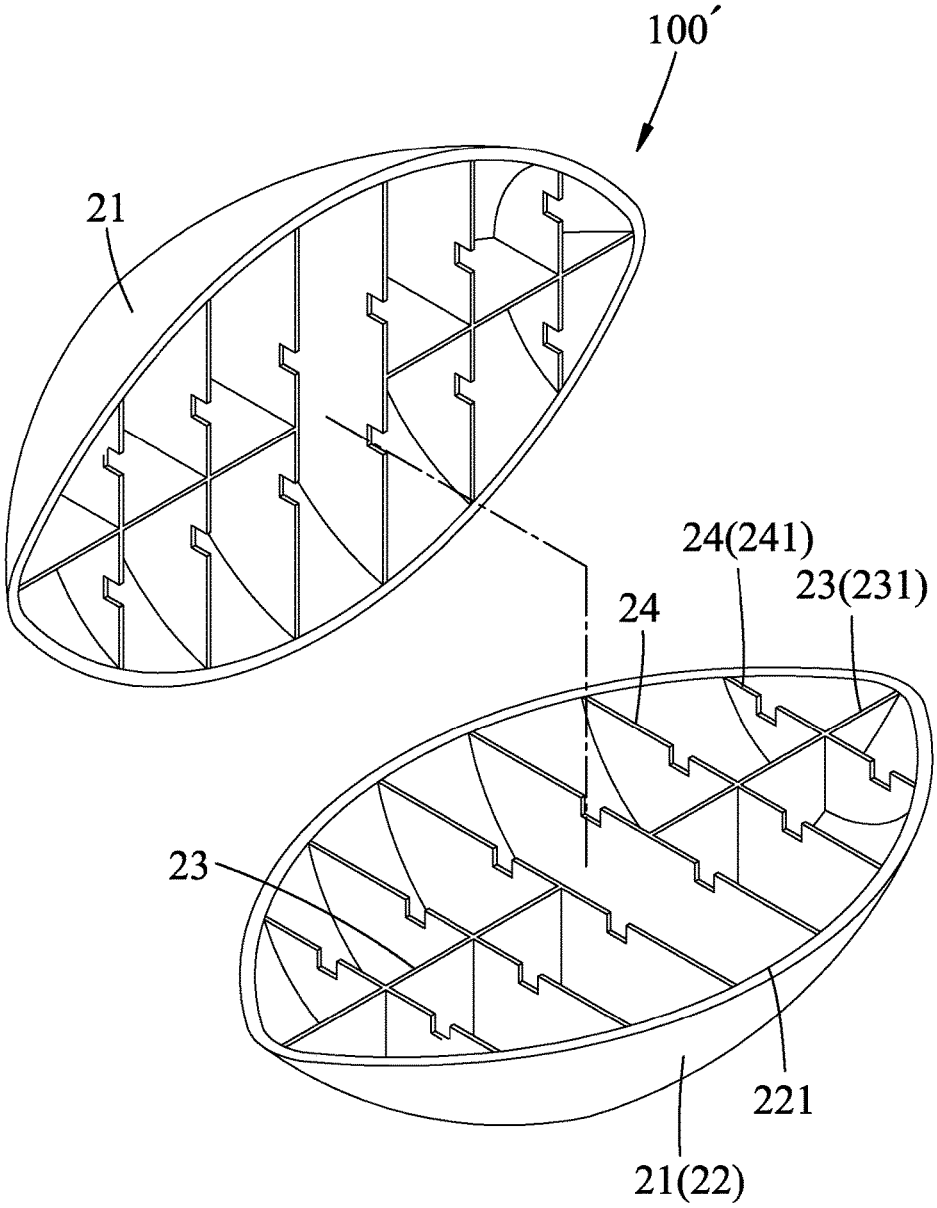
FIG. 5 is an exploded perspective view of an inner bladder of an inflatable sports ball according to the second embodiment of the present disclosure.

Referring to FIG. 5, the second embodiment of the inflatable sports ball 100' of the present disclosure is shown to be identical to the first embodiment. However, in this embodiment, the free end 231, 241 of each of the first and second rib plates 23, 24 of each bladder half 21 is flush with the peripheral edge surface 221 of the surrounding wall 22 of the corresponding bladder half 21. The advantages of the first embodiment can be similarly achieved using the second embodiment.

Figure 6:
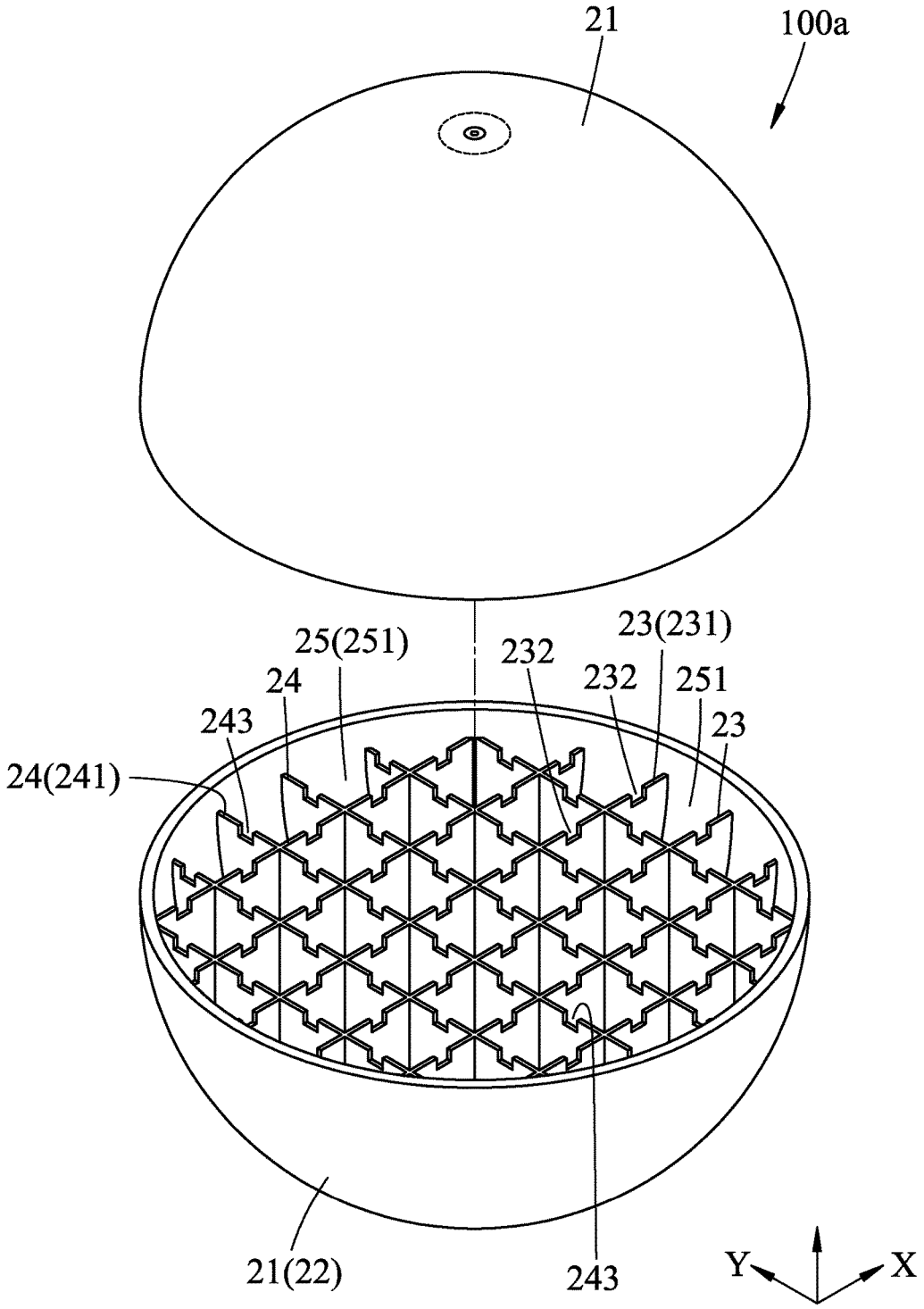
FIG. 6 is an exploded perspective view of an inner bladder of an inflatable sports ball according to the third embodiment of the present disclosure.

Referring to FIG. 6, the third embodiment of the inflatable sports ball (100*a*) of the present disclosure is shown to be identical to the first embodiment. However, in this embodiment, the number of the first rib plates 23 of each bladder half 21 is equal to the number of the second rib plates 24 thereof, and the first rib plates 23 are spaced apart from each other along the second direction (Y). The first and second rib plates 23, 24 intersect each other to divide the inflatable space 25 into a plurality of the inflatable regions 251. Each first rib plate 23 has a plurality of first grooves 232 extending inwardly from the free end 231 of a corresponding one of the first rib plates 23 and spaced apart from each other along the first direction (X). Each of the first grooves 232 communicates with two adjacent ones of the inflatable regions 251.

The second rib plates 24 of this embodiment are spaced apart from each other along the first direction (X), and each second rib plate 24 has a plurality of second grooves 243 extending inwardly from the free end 241 of a corresponding one of the second rib plates 24 and spaced apart from each other along the second direction (Y). Each of the second grooves 243 communicates with two adjacent ones of the inflatable regions 251.

The advantages of the first embodiment can be similarly achieved using the third embodiment. Moreover, it should be noted herein that the first and second grooves 232, 243 of each bladder half 21 may be dispensed with in other variations of this embodiment.

Figure 7:
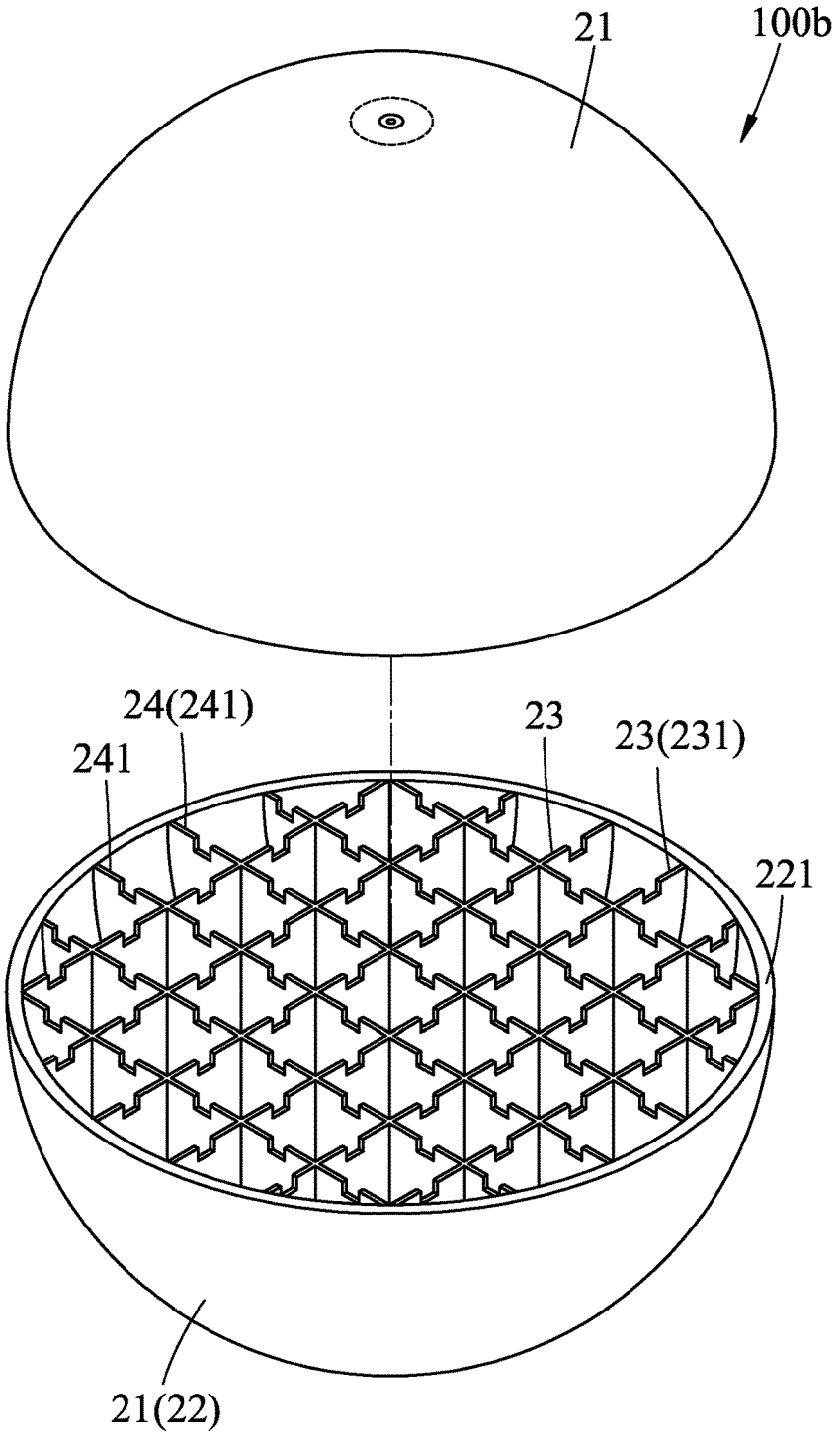
FIG. 7 is an exploded perspective view of an inner bladder of an inflatable sports ball according to the fourth embodiment of the present disclosure.

Referring to FIG. 7, the fourth embodiment of the inflatable sports ball (100*b*) of the present disclosure is shown to be identical to the third embodiment. However, in this embodiment, the free end 231, 241 of each of the first and second rib plates 23, 24 of each bladder half 21 is flush with the peripheral edge surface 221 of the surrounding wall 22 of the corresponding bladder half 21. The advantages of the third embodiment can be similarly achieved using the fourth embodiment.

While the disclosure has been described in connection with what are considered the exemplary embodiments, it is understood that this disclosure is not limited to the disclosed embodiments but is intended to cover various arrangements included within the spirit and scope of the broadest interpretation so as to encompass all such modifications and equivalent arrangements.

What is claimed is:

1. An inflatable sports ball comprising:

an outer cover defining an interior space, and including a valve hole communicating with said interior space;

an inner bladder disposed in said interior space, and including two bladder halves fixed to each other, each of said bladder halves having a surrounding wall and a plurality of rib plates, said surrounding wall having an inner wall surface that defines an inflatable space, an outer wall surface opposite to said inner wall surface, and a peripheral edge surface interconnecting peripheral edges of said inner and outer wall surfaces, said rib plates intersecting with each other to divide said inflatable space into a plurality of inflatable regions, said peripheral edge surfaces of said surrounding walls of said bladder halves being connected to each other; and an inflation unit disposed on said inner bladder and aligned with said valve hole;

wherein two of said rib plates are defined as first rib plates, and the rest of said rib plates are defined as second rib plates, said first rib plates extending along a first direction and being spaced apart from each other along the first direction, said second rib plates extending along a second direction transverse to the first direction and being spaced apart from each other along the first direction, a half number of said second rib plates intersecting with one of said first rib plates, the remaining half number of said second rib plates intersecting with another one of said first rib plates.

2. The inflatable sports ball as claimed in claim 1, wherein each of said first and second rib plates has a connecting end connected to said inner wall surface of said surrounding wall, and a free end opposite to said connecting end, each of said second rib plates further having two grooves extending inwardly from said free end of a corresponding one of said second rib plates and spaced apart from each other along the second direction, said grooves of each of said second rib plates being located at two opposite sides of a corresponding one of said first rib plates, each of said grooves communicating with two adjacent ones of said inflatable regions.

3. The inflatable sports ball as claimed in claim 2, wherein said free end of each of said first and second rib plates is spaced apart from said peripheral edge surface of said surrounding wall at a distance (D) not greater than 5 mm.

4. The inflatable sports ball as claimed in claim 2, wherein said free end of each of said first and second rib plates is flush with said peripheral edge surface of said surrounding wall.

5. An inflatable sports ball comprising:

an outer cover defining an interior space, and including a valve hole communicating with said interior space;

an inner bladder disposed in said interior space, and including two bladder halves fixed to each other, each of said bladder halves having a surrounding wall and a plurality of rib plates, said surrounding wall having an inner wall surface that defines an inflatable space, an outer wall surface opposite to said inner wall surface, and a peripheral edge surface interconnecting peripheral edges of said inner and outer wall surfaces, said rib plates intersecting with each other to divide said inflatable space into a plurality of inflatable regions, said peripheral edge surfaces of said surrounding walls of said bladder halves being connected to each other; and an inflation unit disposed on said inner bladder and aligned with said valve hole;

wherein a half number of said rib plates are defined as first rib plates, and the remaining half number of said rib plates are defined as second rib plates, said first rib plates extending along a first direction and being spaced apart from each other along a second direction transverse to the first direction, said second rib plates extending along the second direction and being spaced apart from each other along the first direction, said first and second rib plates intersecting with each other; and wherein each of said first and second rib plates has a connecting end connected to said inner wall surface of said surrounding wall, and a free end opposite to said connecting end, each of said first rib plates further having a plurality of first grooves extending inwardly from said free end of a corresponding one of said first rib plates and spaced apart from each other along the first direction, each of said first grooves communicating with two adjacent ones of said inflatable regions, each of said second rib plates further having a plurality of second grooves extending inwardly from said free end of a corresponding one of said second rib plates and spaced apart from each other along the second direction, each of said second grooves communicating with two adjacent ones of said inflatable regions.

6. The inflatable sports ball as claimed in claim 5, wherein said free end of each of said first and second rib plates is spaced apart from said peripheral edge surface of said surrounding wall at a distance (D) not greater than 5 mm.

7. The inflatable sports ball as claimed in claim 5, wherein said free end of each of said first and second rib plates is flush with said peripheral edge surface of said surrounding wall.

8. The inflatable sports ball as claimed in claim 1, wherein each of said bladder halves is made of a material selected from a group consisting of thermoplastic polyurethane (TPU), thermoplastic elastomer (TPE), thermoplastic polyolefin (TPO) and thermoplastic rubber (TPR).

9. The inflatable sports ball as claimed in claim 5, wherein each of said bladder halves is made of a material selected from a group consisting of thermoplastic polyurethane (TPU), thermoplastic elastomer (TPE), thermoplastic polyolefin (TPO) and thermoplastic rubber (TPR).

* * * * *